US006496098B1

(12) United States Patent
Kern et al.

(10) Patent No.: US 6,496,098 B1
(45) Date of Patent: Dec. 17, 2002

(54) PYROTECHNIC ACTIVE ELEMENT

(75) Inventors: Heinz Kern, Furth (DE); Wolfgang Mosig, Hartmannshof (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 09/462,061

(22) PCT Filed: Jun. 23, 1998

(86) PCT No.: PCT/EP98/03838

§ 371 (c)(1),
(2), (4) Date: Mar. 30, 2000

(87) PCT Pub. No.: WO99/01880

PCT Pub. Date: Jan. 14, 1999

(30) Foreign Application Priority Data

Jul. 4, 1997 (DE) ..... 197 28 658

(51) Int. Cl.[7] ..... H01H 37/76; H01H 85/055

(52) U.S. Cl. ..... 337/401; 337/182; 337/185; 337/405; 361/115

(58) Field of Search ..... 337/157, 401, 337/404–409, 182, 185; 307/9.1–10.8, 119; 180/271, 274, 279, 281–283; 200/61.08; 361/115; 280/734, 735

(56) References Cited

U.S. PATENT DOCUMENTS 3,728,934 A * 4/1973 Palmer ..... 89/1 B
3,803,374 A 4/1974 Delgendre
3,859,483 A * 1/1975 Laserson et al. ..... 200/61.45
3,873,786 A * 3/1975 Lagofun ..... 200/61.08
3,915,236 A * 10/1975 Stichling ..... 169/61
4,224,487 A * 9/1980 Simonsen ..... 200/61.08
4,417,519 A * 11/1983 Lutz ..... 102/263
4,527,025 A * 7/1985 Patrichi et al. ..... 200/61.08
5,877,563 A * 3/1999 Krappel et al. ..... 307/10.1

FOREIGN PATENT DOCUMENTS

| | | |
|---|---|---|
| DE | 1640913 | 3/1967 |
| DE | 2317930 | 4/1973 |
| DE | 3701133 | 1/1987 |
| DE | 4211079 | 4/1992 |
| DE | 4422177 | 6/1994 |

* cited by examiner

*Primary Examiner*—Lynn D. Feild
*Assistant Examiner*—Anatoly Vortman
(74) *Attorney, Agent, or Firm*—Antonelli, Terry, Stout & Kraus, LLP

(57) ABSTRACT

A pyrotechnic active element for separating media and/or fluids has a base element (12) and an electrical ignition element (26) which is arranged on or in the base element (12). The pyrotechnic active element also includes a pyrotechincal charge (28) which can be ignited by the ignition element (26), in addition to a separating element (14) which is fitted with a separating tool (40) and a fixing member (34) for the tool. The fixing element (34) is hermetically sealed to the base element (12). The connection is disrupted when the pyrotechnical charge (28) is ignited.

2 Claims, 3 Drawing Sheets

PYROTECHNIC ACTIVE ELEMENT

BACKGROUND OF THE INVENTION

The invention relates to a pyrotechnic active element for severing media and/or fluids.

DE 42 11 079 A1 and DE 44 22 177 describe pyrotechnically acting fuse elements which have a housing having a hollow space formed therein through which extends transversely with respect to the longitudinal extent thereof, an electrical conductor to be severed in the event of an overcurrent. Arranged in the hollow space is a severing piston which, upon ignition of a pyrotechnic charge, can be moved forwards in the direction of the conductor in order to sever the latter.

The assembly and the construction of the known pyrotechnic fuse elements are extremely costly and the pyrotechnic elements, such as the electrical ignition element and charge and also the severing piston, are to be produced specifically according to the respective needs of the client, which is cost-intensive.

SUMMARY OF THE INVENTION

The underlying object of the invention is to develop a pyrotechnic active element having a reduced number of components to be built up separately during the assembly.

In order to achieve this object, there is proposed in accordance with the invention a pyrotechnic active element which is provided with

- a base element,
- an electrical ignition element which is arranged on or in the base element,
- a pyrotechnic charge which can be ignited by the ignition element, and
- a severing element which has a severing tool and a holding element holding the latter,
- wherein the holding element is connected in a sealed manner to the base element and this connection is releasable upon ignition of the pyrotechnic charge.

The active element in accordance with the invention has electrical ignition element, as it were, as a support for the pyrotechnic charge, and, for holding the terminal contacts of the ignition element, it has a base element to which the cutting element is connected. This connection is moisture-tight and, in particular, is gas-tight, so that the pyrotechnic charge is not rendered inoperative by external influences (penetration of moisture) during the storage of the pyrotechnic active element. On the one hand, the mechanical connection of base element and severing element is mechanically secure such that the two portions do not unintentionally separate from each other during handling and in particular during mounting in a primary unit (for example installation in the housing of an electrical fuse element). On the other hand, the connection of base element and severing element must reliably become detached when the pyrotechnic charge is ignited in accordance with the requirements, without a considerable force being required for this purpose, so that all of the energy released upon ignition of the pyrotechnic charge is converted into kinetic energy of the severing element.

As a result of the active element in accordance with the invention being a self-contained component, an active element once ignited can be removed from its primary unit and replaced with a new active element.

The pyrotechnic active element in accordance with the invention is generally to be used in primary units in which one is concerned with severing or interrupting a medium (for example an electrical conductor) or a flowing fluid (flow of liquid or gas, or viscous substances). The severing tool of the severing element is made of a suitable material (for example metal, ceramics, plastics) depending on the properties and fields of use of the medium or fluid. In the case of the use of the active element in accordance with the invention in an electrical fuse element, the severing tool consists of a non-conductive material, preferably plastics, in which case materials of the raw-material groups polyamide, polycarbonate, polyphenylene sulphide or suchlike with mineral, organic or inorganic fillers are to be mentioned here, in particular.

In an advantageous development of the invention, it is provided that the detachable connection between the base element and the severing element is material-locking, friction-locking and/or form-locking up to a minimum strength, something which can take place in particular by gluing, (ultrasonic) welding, caulking, camming or locking together.

The connection between the severing element and the base element is preferably provided with predetermined breaking points which break open when the pyrotechnic charge explodes and release the severing element. The severing element of the active element in accordance with the invention has the severing tool and a holding element which holds the latter and is preferably constructed in one piece with the severing tool.

In an advantageous development of the invention, in order to achieve the tightness in the unit of the severing element and the base element, at least one O-ring is provided. This sealing ring is preferably arranged in a circumferential groove of the base element or the severing element and rests tightly against the respective other element in the region in which it protrudes above the circumferential groove. The holding element of the severing element (or alternatively the base element) preferably has a protruding encompassing collar, which surrounds the base element (or alternatively the holding element).

BRIEF DESCRIPTION OF THE DRAWINGS

Preferred exemplifying embodiments of the invention are explained in greater detail with the aid of the drawing in the following, in which.

DETAILED DESCRIPTION OF THE PREFERRED EMBODIMENTS

Figure 1:
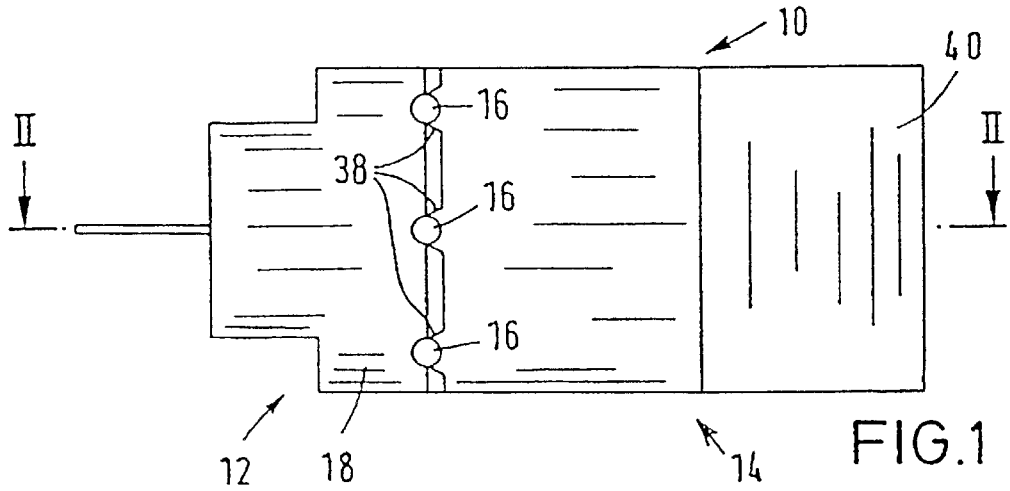
FIGS. 1 and 2 show a side view of and a longitudinal section through a pyrotechnic active element in accordance with a first exemplifying embodiment.
Figure 2:
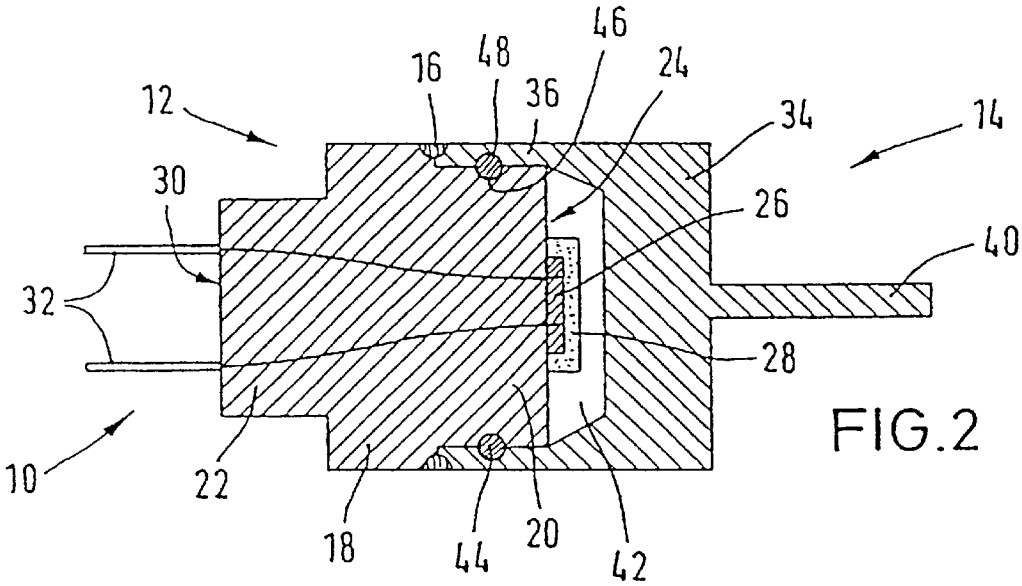
Figure 3:
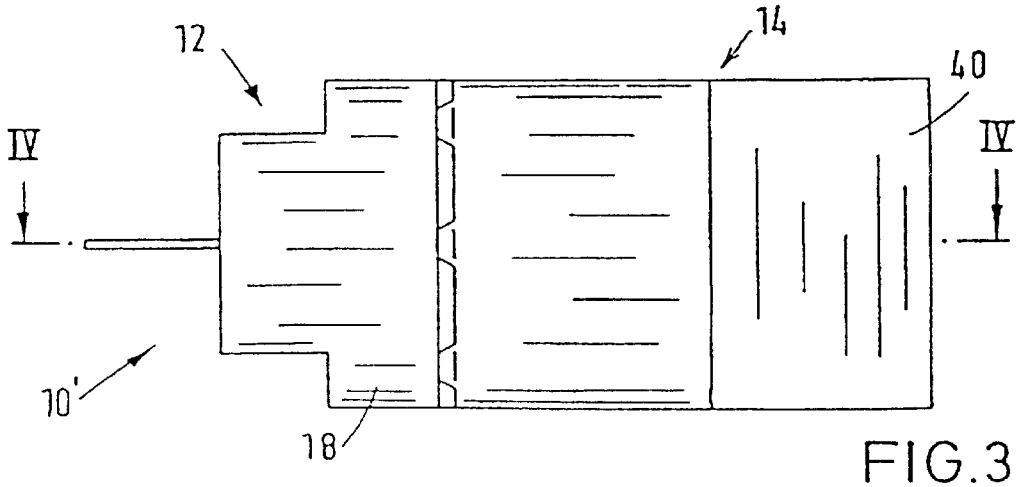
FIGS. 3 and 4 show a side view of and a longitudinal section through a pyrotechnic active element in accordance with a second exemplifying embodiment.
Figure 4:
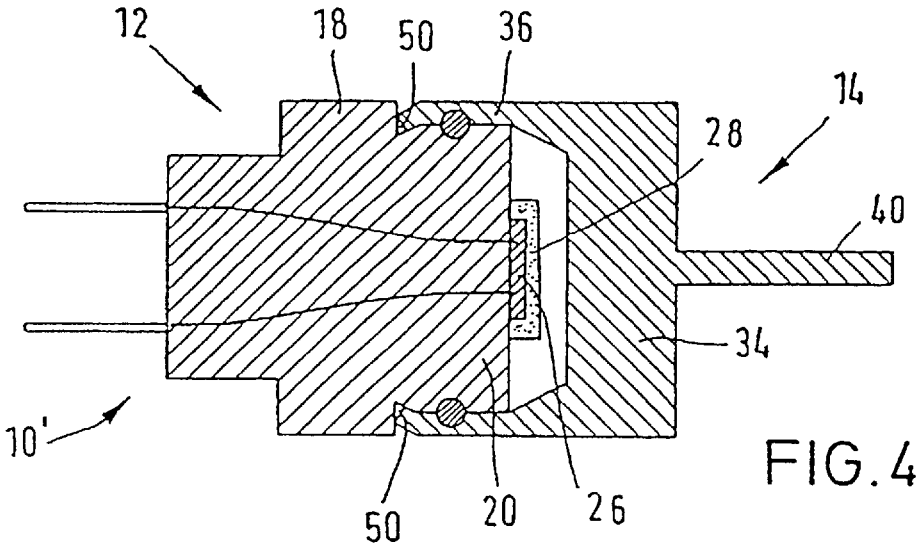

FIGS. 1 and 2 show a side view of and a longitudinal section through a pyrotechnic active element 10, which has a base element 12 and a severing element 14 which are spot welded to each other at 16. Both portions of the active element 10 consist of the same plastics material and can thus be ultrasonically welded. The base element is rotationally symmetrical and provided in particular with cylindrical individual sections. In its centre section, viewed in terms of its axial extent, the base element has a shoulder 18 from which extend on both sides projections 20, 22, the external diameters of which are smaller than that of the shoulder 18. At the end-face end 24 of one of the projections 20 is an electrical ignition element 26 and a pyrotechnic charge 28, while two connection pins 32 which are electrically connected to the ignition element 26 project from the end-face end 30 of the other projection 22.

The severing element 14 has a cylindrical holding element 34 which is provided with an axially protruding encompassing collar 36 which surrounds, from the outside, the projection 20 of the base element 12 that carries the ignition element 26 and the pyrotechnic charge 28, and rests on the shoulder 18 of the base element 12, to which it is spot welded. For this purpose, the encompassing collar 36 has a plurality of axial projections 38 which are welded to the shoulder 18 of the base element at 16. On the side facing away from the encompassing collar, the holding element 34 of the severing element 14 carries a severing tool 40 which extends along the diameter of the holding element 34 and protrudes axially therefrom. The severing tool 40 is constructed as a cutter and is connected in one piece to the holding element 34.

The external diameter of the encompassing collar 36 is chosen so as to be substantially equal to the external diameter of the shoulder 18 of the base element 12, while its thickness is substantially equal to the difference in diameter between the shoulder 18 and the projection 20 of the base element 12 that is surrounded by the encompassing collar 36.

The punctiform weld joint between the base element 12 and the severing element 14 has a sufficient strength for the handling and installation of the active element 10. On the other hand, the connection automatically detaches reliably when the pyrotechnic charge 28 ignites, so that the base element 12 releases the severing element 14.

In order to protect the hollow space 42 formed between the end-face end 24 of the projection 20 of the base element 12, which projection carries the ignition element 26 and the pyrotechnic charge 28, and the holding element 34 of the severing element 14 against the penetration of moisture, there is provided a circumferential sealing ring 44, which is arranged in opposing circumferential recesses 46 and 48 on the outside of the projection 20 and the inside of the collar 36.

The active element is used, for example, in an electrical fuse element, as described in DE 42 11 079. In this connection, it is advantageous for the assembly that the ignition element 26, the pyrotechnic charge 28 and the base element 12 as well as the severing element 14 can be installed as a prefabricated unit.

The two further exemplifying embodiments of the pyrotechnic active element 10' and 10" that are shown in FIGS. 3 to 6 correspond to a considerable extent in terms of their structure to the pyrotechnic active element 10 in accordance with FIGS. 1 and 2. To this extent, the same reference numbers are used in FIGS. 3 to 6 for parts which are the same or have the same function.

The difference between the active element 10' and the active element 10 consists in the type of mechanical connection of the severing element 14 to the base element 12. In the exemplifying embodiment in accordance with FIGS. 3 and 4, the projection 20 of the base element namely has in the region of its transition to the shoulder 18 a circumferential nick 50 into which the free end of the encompassing collar 36 enters as a result of plastic deformation. As a result of this, a mechanical connection with sufficient strength for the assembly and handling of the active element 10' results.

Figure 5:
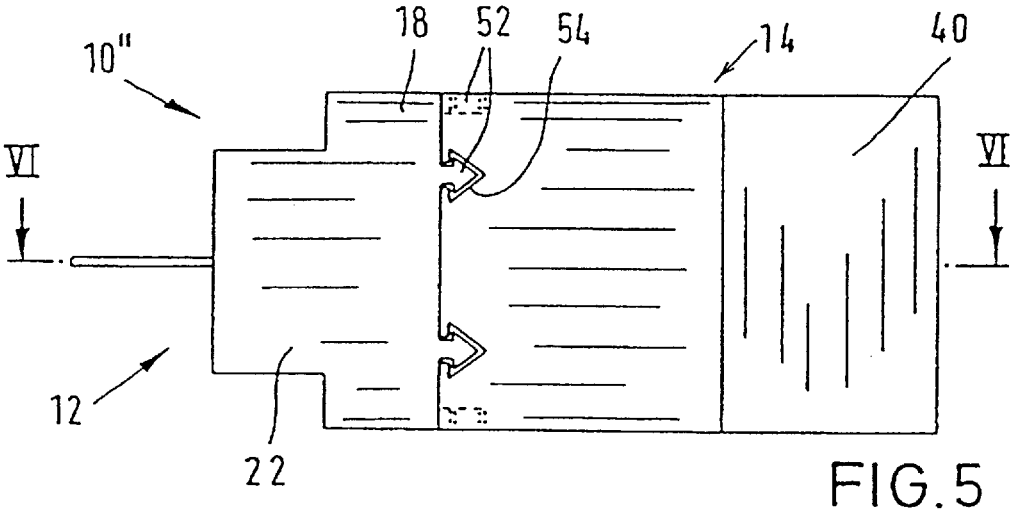
FIGS. 5 and 6 show a side view of and a longitudinal section through a pyrotechnic active element in accordance with a third exemplifying embodiment.
Figure 6:
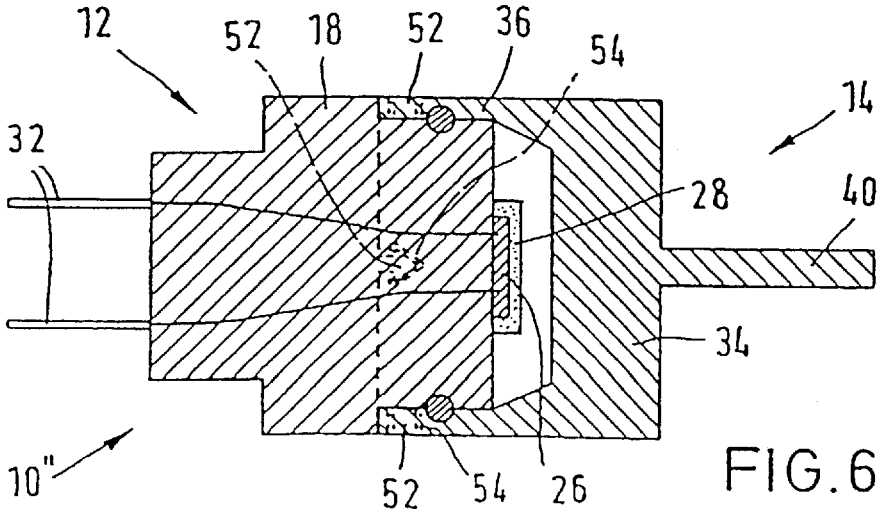

In the exemplifying embodiment in accordance with FIGS. 5 and 6, the mechanical connection between the base element 12 and the severing element 14 takes place by a mechanical locking, locking elements 52 protruding axially from the shoulder 18 of the base element 12 and engaging in corresponding locking recesses 54 on the free end of the encompassing collar 36 of the holding element 34 of the severing element 14.

Figure 7:
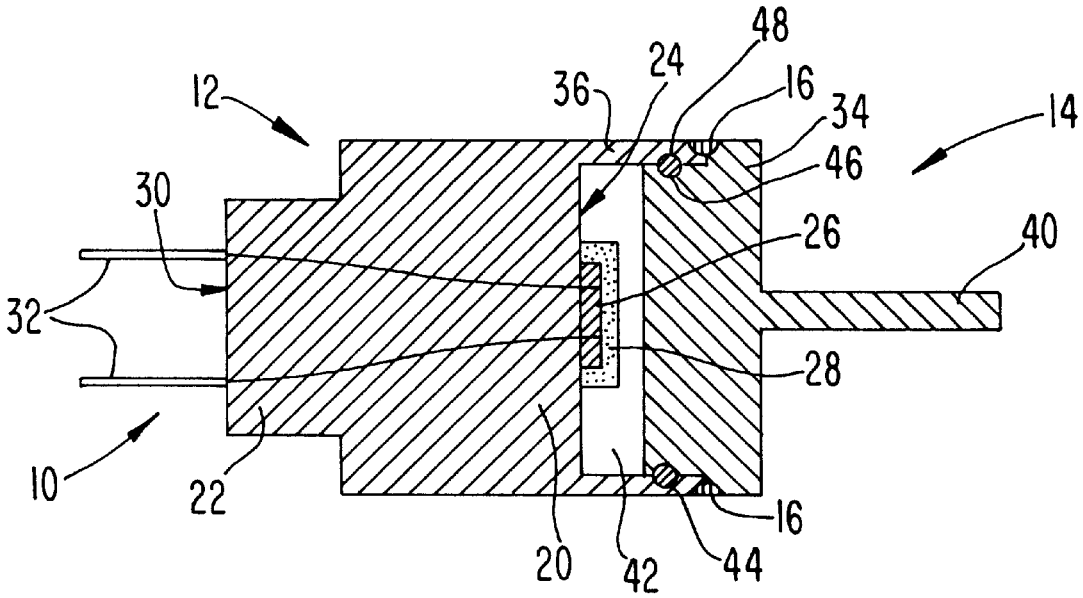
FIG. 7 shows a longitudinal section through a pyrotechnic active element in accordance with a fourth exemplifying embodiment.

In the exemplifying embodiment in accordance with FIG. 7, the base element 12 has a protruding encompassing collar 36 for laterally surrounding at least a part of the holding element 34 of the severing element 14.

What is claimed is:

1. A pyrotechnic active element for severing media and/or fluids, comprising:

a base element;

an electrical ignition element arranged on or in the base element;

a pyrotechnic charge which can be ignited by the ignition element; and a severing element which as a severing tool and a holding element holding the severing tool, wherein the holding element is connected in a sealed manner to the base element with a connection, and detachable upon ignition of the pyrotechnic charge, the connection comprising a protruding encompassing collar provided on the holding element or the base element for laterally surrounding at least part of the base element or the holding element and, on the base element or the holding element, in the region of its portion which is surrounded by the encompassing collar of the holding element or of the base element, a circumferential groove having a sealing ring arranged therein.

2. Active element according to claim 1, wherein the holding element and the severing tool are connected in one piece to each other.

* * * * *